US011668152B2

(12) United States Patent
Skauen et al.

(10) Patent No.: US 11,668,152 B2
(45) Date of Patent: Jun. 6, 2023

(54) CHRISTMAS TREE AND ASSEMBLY FOR CONTROLLING FLOW FROM A COMPLETED WELL

(71) Applicant: AKER SOLUTIONS AS, Lysaker (NO)

(72) Inventors: Torgeir Skauen, Asker (NO); Stuart Spitz, Reading (GB)

(73) Assignee: AKER SOLUTIONS AS, Lysaker (NO)

( * ) Notice: Subject to any disclaimer, the term of this patent is extended or adjusted under 35 U.S.C. 154(b) by 0 days.

(21) Appl. No.: 17/635,010

(22) PCT Filed: Aug. 14, 2020

(86) PCT No.: PCT/NO2020/050205
§ 371 (c)(1),
(2) Date: Feb. 14, 2022

(87) PCT Pub. No.: WO2021/029776
PCT Pub. Date: Feb. 18, 2021

(65) Prior Publication Data

US 2022/0290521 A1 Sep. 15, 2022

(30) Foreign Application Priority Data

Aug. 15, 2019 (GB) ..... 1911666

(51) Int. Cl.
*E21B 33/038* (2006.01)
*E21B 47/117* (2012.01)
*E21B 33/035* (2006.01)

(52) U.S. Cl.
CPC ..... *E21B 33/0385* (2013.01); *E21B 47/117* (2020.05); *E21B 33/0355* (2013.01)

(58) Field of Classification Search
CPC . E21B 33/0385; E21B 47/117; E21B 33/0355
See application file for complete search history.

(56) References Cited

U.S. PATENT DOCUMENTS 9,856,711 B2 * 1/2018 Nguyen ..... E21B 33/038
9,896,897 B2 * 2/2018 Brown ..... E21B 43/128
(Continued)

FOREIGN PATENT DOCUMENTS

CN 102561979 A 7/2012
CN 103883285 A 6/2014
(Continued)

*Primary Examiner* — Aaron L Lembo
(74) *Attorney, Agent, or Firm* — Norman B. Thot

(57) ABSTRACT

A Christmas tree includes a main body, an bulkhead connector, a wet-mate connector, a cable, and a sensor. The main body has a first and a second main body end, and a further passage, and encloses a main passage. The further passage includes a first further passage end at a main body exterior and a second further passage end at the main passage, and extends from the first to the second further passage end. The bulkhead connector is secured to the main body exterior to close the first further passage end, and has a first and a second electrical connection. The wet-mate connector is mounted in the second further passage end to close the second further passage end. The cable transmits an electrical signal and connects the first electrical connection to the wet-mate connector. The sensor is arranged in the further passage and electrically connects to the second electrical connection.

17 Claims, 1 Drawing Sheet

(56) References Cited

U.S. PATENT DOCUMENTS

| | | | | |
|---|---|---|---|---|
| 10,030,509 | B2 * | 7/2018 | Mulholland | E21B 33/03 |
| 11,401,768 | B2 * | 8/2022 | Kardec | E21B 33/043 |
| 2005/0269096 | A1 | 12/2005 | Milberger et al. | |
| 2006/0042791 | A1 | 3/2006 | Ilosie et al. | |
| 2006/0042799 | A1 | 3/2006 | Hosie et al. | |
| 2008/0110633 | A1 | 5/2008 | Trewhella | |
| 2009/0223674 | A1 * | 9/2009 | Christie | E21B 33/0385 166/368 |
| 2010/0051286 | A1 | 3/2010 | Mcstay et al. | |
| 2012/0097383 | A1 | 4/2012 | Fenton | |
| 2013/0056219 | A1 | 3/2013 | Miller | |
| 2015/0252635 | A1 | 9/2015 | Hartley et al. | |
| 2015/0275608 | A1 | 10/2015 | Breda et al. | |
| 2016/0069178 | A1 | 3/2016 | Mulholland et al. | |
| 2018/0320470 | A1 | 11/2018 | Foley et al. | |
| 2019/0195028 | A1 * | 6/2019 | Fripp | E21B 33/0385 |
| 2021/0111589 | A1 * | 4/2021 | Fripp | E21B 17/0283 |
| 2021/0285291 | A1 | 9/2021 | Murphy | |
| 2021/0358295 | A1 * | 11/2021 | Dinkins | E21B 47/008 |

FOREIGN PATENT DOCUMENTS

| | | | |
|---|---|---|---|
| EP | 3 399 140 | A2 | 11/2018 |
| GB | 2 398 309 | A | 8/2004 |
| WO | WO 2018/048396 | A1 | 3/2018 |
| WO | WO 2019/094018 | A1 | 5/2019 |

* cited by examiner

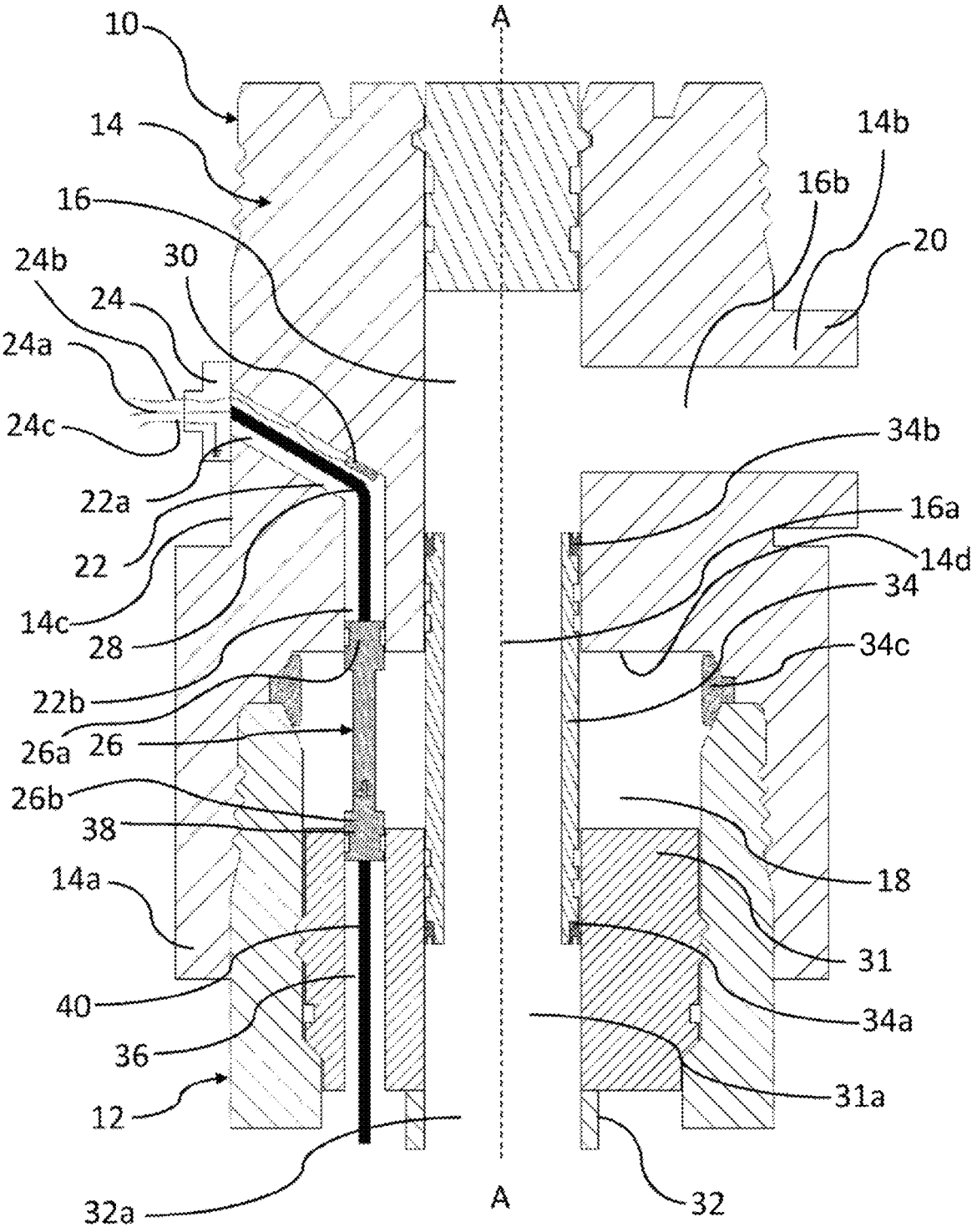
10
A
14
14b
16
16b
20
24b
30
24
24a
24c
34b
22a
16a
22
14d
34
14c
28
34c
22b
26a
26
26b
38
18
14a
31
40
34a
36
31a
12
32a
A
32

CHRISTMAS TREE AND ASSEMBLY FOR CONTROLLING FLOW FROM A COMPLETED WELL

CROSS REFERENCE TO PRIOR APPLICATIONS

This application is a U.S. National Phase application under 35 U.S.C. § 371 of International Application No. PCT/NO2020/050205, filed on Aug. 14, 2020 and which claims benefit to Great Britain Patent Application No. 1911666.4, filed on Aug. 15, 2019. The International Application was published in English on Feb. 18, 2021 as WO 2021/029776 A1 under PCT Article 21(2).

FIELD

The present invention relates to an assembly such as a Christmas tree for controlling a flow of fluid from a completed oil or gas well.

BACKGROUND

Flow of oil and/or gas from a well is controlled, in part, using a metallic assembly of valves, spools, and fittings known as a Christmas tree. The Christmas tree is mounted on top of the wellhead or a completed well, and while its primary function is to control flow into or out of the well, it also has many other functions, including providing ports for the injection of chemicals into the well (chemical injection ports), supplying hydraulic functions in the well bore, pressure relief valves for relieving pressure in the well, and connections to sensors for monitoring conditions in the well such as pressure, temperature, flow rate, fluid composition etc. It also provides valves which are operable to shut-in the well in the event of an emergency.

The Christmas tree has a main body, known as a master valve block (MVB), which encloses a main passage, a first end of which is connected to the production tubing, via a tubing hanger, and a second end of which is connected to the production flowline, so that well fluid flows from the production tubing along the main passage of the Christmas tree to the production flowline. The production tubing is suspended from a tubing hanger which may be mounted in the wellhead as is typical in a vertical Christmas tree, or in the main passage of the Christmas tree, as is known in horizontal Christmas trees.

In vertical Christmas trees, the Christmas tree is provided with an electrical feedthrough system (EFS) in order to facilitate communication of electrical signals to and from the sensors provided for monitoring conditions in the well This comprises a passage, which is known as the electrical feedthrough void (or EFS void), which extends through the MVB from the exterior thereof to the main passage. In known arrangements, a multi-pin electrical bulkhead is mounted on a radially outwardly facing exterior surface of the MVB to seal the exterior end of the EFS void. The electrical bulkhead is connected, in one arrangement, by a single-signal cable, to an EFS single-pin wet-mate connector (WMC) which is mounted in the main passage of the Christmas tree at the lowermost end of the MVB. The WMC is configured to enter into a sealing engagement with the MVB so as to prevent fluid from the main passage of the Christmas tree from entering the EFS void.

SUMMARY

In an embodiment, the present invention provides a Christmas tree which includes a main body, an electrical bulkhead connector, a wet-mate connector, a cable, and a sensor. The main body comprises a first main body end which is configured to be secured to a wellhead, a second main body end which is configured to be connected to a production flowline, and a further passage. The main body is configured to enclose a main passage as a first fluid flow path which extends from the first main body end to the second main body end so that a fluid in the wellhead can pass along the main passage to the production flowline. The further passage comprises a first further passage end at an exterior of the main body and a second further passage end at the main passage. The further passage is configured to extend from the first further passage end to the second further passage end so as to provide a second fluid flow path from the main passage to the exterior of the main body. The electrical bulkhead connector is secured to the exterior of the main body so as to close the first further passage end. The electrical bulkhead connector comprises a first electrical connection and a second electrical connection. The wet-mate connector is mounted in the second further passage end so as to close the second further passage end. The cable is configured to transmit an electrical signal and to electrically connect the first electrical connection of the electrical bulkhead connector to the wet-mate connector. The sensor is arranged in the further passage. The sensor is electrically connected to the second electrical connection of the electrical bulkhead connector.

BRIEF DESCRIPTION OF THE DRAWING

The present invention is described in greater detail below on the basis of embodiments and of the drawing in which:

The FIGURE shows a schematic illustration of a longitudinal cross-section through a well completion assembly according to the second aspect of the present invention.

DETAILED DESCRIPTION

The present invention relates to an improved configuration of a vertical Christmas tree in which a device is provided for monitoring a physical parameter, such as pressure, temperature, vibration (acoustic or otherwise), in the EFS void.

A first aspect of the present invention provides a Christmas tree having a main body which encloses a main passage, the main body having a first end which is adapted to be secured to a wellhead, and a second end which is adapted to be connected to a production flowline, the main passage extending from the first end to the second end of the main body so that fluid in the wellhead can pass along the main passage to the production flowline, the main body being provided with a further passage which extends from a first end at the exterior of the main body to a second end at the main passage, and therefore provides a further fluid flow path from the main passage to the exterior of the main body of the Christmas tree, an electrical bulkhead connector which is secured to the exterior of the main body to close the first end of the further passage, a wet-mate connector which is mounted in the second end of the further passage to close the second end of the further passage, a first electrical connection of the bulkhead connector being electrically connected to the wet mate connector by a cable suitable for transmission of an electrical signal, and a sensor which is located in the further passage and which is electrically connected to a second electrical connection of the bulkhead connector.

The sensor may be a pressure sensor, a temperature sensor, or a vibration (acoustic or otherwise) sensor.

The bulkhead connector may further comprise a third electrical connection which may be earthed.

The wet-mate connector may have a first end which is located in the second end of the further passage, and a second end which extends into the main passage of the Christmas tree and which is configured to engage and form an electrical connection with a further, corresponding, electrical connector.

The bulkhead connector may comprise a multi-pin electrical bulkhead.

The main passage may have a first portion which has a longitudinal axis which, when the Christmas tree is mounted on a wellhead, extends generally parallel to a main fluid flow passage through the wellhead, the main body having a radially outwardly facing exterior surface which is generally parallel to the longitudinal axis of first portion of the main passage. The first end of the further passage may in this case form a port in the radially outwardly facing exterior surface of the main body.

The main body may be provided with a production flowline connector which is adapted to be connected to a production flowline so that fluid can flow from the main passage in the Christmas tree into the production flowline. The main passage may in this case have a second portion which extends generally perpendicular to the first portion through the production flowline connector, the production flowline connector being provided on the radially outwardly facing exterior surface of the main body.

The second end of the further passage may extend into the first portion of the main passage.

The further passage may comprise a first portion which extends into the main body from the radially outwardly facing exterior surface of the main body, and a second portion which extends into the main body to the first portion from the first portion of the main passage. The second portion of the further passage may extend generally parallel to the longitudinal axis of the first portion of the main passage.

The first portion of the main passage may have a larger diameter portion at the first end of the main body, and a smaller diameter portion which extends from the larger diameter portion to the second portion of the main passage, the main body providing a shoulder between the larger diameter portion and the smaller diameter portion of the main passage, the shoulder extending generally perpendicular to the longitudinal axis of the first portion of the main passage. The second end of the further passage may in this case extend to and form a port in the shoulder.

A second aspect of the present invention provides a well completion assembly comprising a wellhead having a Christmas tree according to the first aspect of the present invention mounted thereon, and a tubing hanger mounted in the wellhead.

The wet-mate connector may be connected to a corresponding wet-mate connector provided in the tubing hanger.

A third aspect of the present invention provides a method of pressure testing a Christmas tree according to the first aspect of the present invention, wherein the sensor comprises a pressure sensor, the method comprising pumping pressurized fluid into the main passage, and using the sensor to monitor the pressure in the further passage.

An embodiment of the present invention will now be described with reference to the accompanying drawing which shows a schematic illustration of the longitudinal cross-section through a well completion assembly according to the second aspect of the present invention.

The FIGURE shows a Christmas tree 10 mounted on a wellhead 12. The Christmas tree 10 has a main body 14 which encloses a main passage 16, the main body 14 having a first end 14*a* which is secured to the wellhead 12 in a standard way, and a second end 14*b* which is adapted to be connected to a production flowline (which is not shown in the FIGURE). The main passage 16 extends from the first end 14*a* to the second end 14*b* of the main body 14 so that fluid in the wellhead 12 can pass along the main passage 16 to the production flowline.

In the shown embodiment, the main passage 16 has a first portion 16*a* which has a longitudinal axis A which extends generally parallel to a main fluid flow passage 18 through the wellhead 12, the main body 14 having a radially outwardly facing exterior surface 14*c* which is generally parallel to the longitudinal axis A of first portion 16*a* of the main passage 16.

In the shown embodiment, the main body 14 is provided with a production flowline connection 20 which is adapted to be connected to the production flowline so that fluid can flow from the main passage 16 in the Christmas tree 10 into the production flowline. In this embodiment, the main passage 16 has a second portion 16*b* which extends generally perpendicular to the first portion 16*a* through the production flowline connection 20, the production flowline connection 20 being provided on the radially outwardly facing exterior surface 14*c* of the main body 14. Although not essential, in this embodiment, the first portion 16*a* of the main passage 16 has a larger diameter portion at the first end 14*a* of the main body 14, and a smaller diameter portion which extends from the larger diameter portion to the second portion 16*b* of the main passage 16, the main body 14 providing a shoulder 14*d* between the larger diameter portion and the smaller diameter portion of the main passage 16. The shoulder 14*d* extends generally perpendicular to the longitudinal axis A of the first portion 16*a* of the main passage 16.

The main body 14 is also provided with a further passage 22 which extends from a first end 22*a* at the exterior of the main body 14 to a second end 22*b* at the main passage 16, and therefore provides a further fluid flow path from the main passage 16 to the exterior of the main body 14 of the Christmas tree 10.

In the shown embodiment, the first end 22*a* of the further passage 22 forms a port in the radially outwardly facing exterior surface of the main body 14. The further passage 22 comprises a first portion which extends into the main body 14 from the radially outwardly facing exterior surface 14*c* of the main body 14, and a second portion which extends into the main body 14 to the first portion from the first portion 16*a* of the main passage 16.

In the shown embodiment, the second end 22*b* of the further passage 22 extends to and forms a port in the shoulder 14*d*, and the second portion of the further passage 22 extends generally parallel to the longitudinal axis A of the first portion 16*a* of the main passage 16.

The Christmas tree 10 is further provided with an electrical bulkhead connector 24 which is secured to the radially outwardly facing exterior surface 14*c* of the main body 14 to close the first end 22*a* of the further passage 22. A wet-mate connector 26 is mounted in the second end 22*b* of the further passage 22 to close the second end 22*b* of the further passage 22. A wet-mate connector is an electrical connector which is designed to operate when submerged in liquid, and therefore includes appropriate seals to prevent liquid from reaching the electrical connections between it and a further wet-mate connector to which it is connected.

A first electrical connection 24*a* of the electrical bulkhead connector 24 is electrically connected to the wet-mate connector 26 by a cable 28 which is suitable for transmission of an electrical signal.

The wet-mate connector 26 has a first end 26*a* which is located in the second end 22*b* of the further passage 22, and a second end 26*b* which extends into the main passage 16 of the Christmas tree 10, and which is configured to engage and form an electrical connection with a further, corresponding, electrical connector. The wet-mate connector 26 includes seals which are configured to seal against the main body 14 and to substantially prevent the ingress of fluid from the main passage 16 into the further passage 22. These seals are advantageously provided on the first end 26*a* of the wet-mate connector 26 to engage with the portion of the main body 14 surrounding the second end 22*b* of the further passage 22.

The Christmas tree 10 further comprises a sensor 30 which is located in the further passage 22 and which is electrically connected to a second electrical connection 24*b* of the bulkhead connector 24. The sensor 30 may be a pressure sensor, a temperature sensor or a vibration/acoustic sensor.

In the shown embodiment, the electrical bulkhead connector 24 further comprises a third electrical connection 24*c* which is earthed.

In the shown embodiment, the electrical bulkhead connector 24 is a four pin electrical bulkhead in which first one of the four pins is connected to the cable 28, a second one of the four pins is connected to the sensor 30, and a third one of the four pins is earthed. The fourth pin is unused in the shown embodiment. It may, however, be connected to a further sensor located in the further passage 22. The second pin could, for example, be connected to a pressure sensor, and the fourth pin could, for example, be connected to a temperature or to a vibration sensor. It will be appreciated, however, that if the electrical bulkhead connector 24 is provided with more than four electrical connections, that more than two sensors could be provided in the further passage 22, with each one being electrically connected to one of the electrical connections of the electrical bulkhead connector 24.

The physical state of the further passage 22 detected by the sensor 30 (and by the further sensor where provided) may therefore be determined by connecting the second and (and fourth if appropriate) electrical connection of the electrical bulkhead connector 24 to an appropriate processor (which is not shown in the FIGURE). The processor is programmed to receive and to process the signal from the or each sensor 30 to transform it into a value of a parameter which describes an aspect of the physical state inside the further passage 22 (such as pressure, temperature, vibration frequency or vibration amplitude). The processor may further be connected to a visual display unit on which the value of the parameter in question is displayed. The processor may additionally or alternatively be connected to an alarm and be programmed to issue an alarm signal (which could be visual, or audible, or both) if the detected value of the parameter in question exceeds a pre-determined level. The processor may additionally or alternatively be connected to or be integral with a processor responsible for the control of equipment which is involved in an aspect of the operation of the Christmas tree.

As described above, in use, the Christmas tree 10 is mounted on a wellhead 12, with the wellhead 12 extending into the first portion of the main passage 16 of the Christmas tree 10 and the first end 14*a* of the main body 14 of the Christmas tree 10 engaging with a radially outwardly facing surface of the wellhead 12. A seal 34*c* is provided between the upper end of the wellhead 12 and the main body 14 of the Christmas tree, just below the shoulder 14*d*.

An annular tubing hanger 31 is mounted in the wellhead 12, and a tubular production casing 32 is suspended from the lower end of the tubing hanger 31. The production casing 32 and tubing hanger 31 both have a central passage 31*a*, 32*a* with a longitudinal axis which coincides with the longitudinal axis A of the first portion 16*a* of the main passage 16 of the Christmas tree, so that fluid from the wellbore can flow upwards through the production casing 32 and the tubing hanger 31, along the main passage 16 of the Christmas tree 10 and into the production flowline.

The tubing hanger 31 is provided with an offset passage 36 which is displaced radially relative to the central passage and, in this embodiment, extends generally parallel to the central passage 31*a*. A tubing hanger wet-mate connector 38 is mounted in the upper end of the offset passage 36 which, in use, is connected to the second end 26*b* of the wet-mate connector 26 of the Christmas tree 10. A further electrical cable 40 extends from the tubing hanger wet-mate connector 38 to connect to electrical equipment or sensors (which is not shown in the FIGURE) in the wellbore.

Although not essential, in the shown embodiment, a tube 34 is mounted in the main passage 16 of the Christmas tree 10, a lower end of the tube 34 extending into the central passage 31*a* of the tubing hanger 31, and an upper end of the tube 34 extending into the smaller diameter portion of the main passage 16 of the Christmas tree 10. Seals 34*a*, 34*b* are provided at the lowermost and uppermost ends of the tube 34, the seal 34*a* at the lowermost end providing a substantially fluid tight seal between the tubing hanger 31 and the tube 34, and the seal 34*b* at the uppermost end providing a substantially fluid tight seal between the main body 14 of the Christmas tree 10 and the tube 34. If the seals 34*a*, 34*b* are effective, the tube 34 should thus prevent fluid from flowing up from the production casing 32 and tubing hanger 31 from entering the annular space around the tube 34 in the larger diameter part of the first portion 16*a* of the main passage 16 in the Christmas tree 10. If the seals 34*a*, 34*b* are completely effective, the mated wet-mate connectors 26, 38 should thus not ordinarily be exposed to fluid from the wellbore.

In use, however, the fluid pressure in the wellbore, and hence the fluid pressure in the main passage 16 of the Christmas tree 10, can reach very high levels, so that leakage of fluid around the seals 34*a*, 34*b* may occur in the event of failure. The wet-mate connectors 26, 38 are configured to provide a substantially fluid tight seal with the main body 16 of the Christmas tree 10 and the tubing hanger 31, respectively, but leakage of fluid could also occur around these seals. It is therefore possible that fluid from the wellbore may enter the further passage 22 in the Christmas tree 10 in the case of multiple sealing failures.

As described above, the electrical bulkhead connector 24 closes the first end 22*a* of the further passage 22 and may be rated to provide a substantially fluid tight seal up to around 100 bar for a standard type design, but if the pressure in the further passage 22 exceeds this level (which is possible, as the fluid pressure in the Christmas tree 10 can exceed 600 bar), contained fluid may leak around the electrical bulkhead connector 24 and enter the environment at the exterior of the Christmas tree 10. Even more problematically, the electrical bulkhead connector 24 may provide an effective seal while the fluid pressure in the further passage 22 builds up to a pressure greater than the pressure rating of the electrical bulkhead connector 24, so that the electrical bulkhead connector 24 can then fail catastrophically, i.e., being blown off by the accumulated pressure in the further passage 22.

Once assembled, the Christmas tree is generally pressure tested by filling various separated sections of the main passage with pressurized fluid to verify that none of the seals which are provided to hold the fluid in the main passage are leaking. Such testing may be carried out when the Christmas tree 10 is mounted on a dummy wellhead or a real wellhead to check the integrity of the seals provided by the wet-mate connector 26. A pressure test passage (which is not shown in the FIGURE) extends through the main body 14 of the Christmas tree 10 into the annular space around the tube 34 and is enclosed by the uppermost end of the wellhead 12, the tubing hanger 31 and the first end 14*a* of the main body 14 of the Christmas tree 10. Fluid is pumped into this annular space via the pressure test passage to check the seals 34*a*, 34*b* between the tube 34 and the tubing hanger 31/main body 14, as well as the seals provided by the engagement of the wet mate connectors 26, 28 and the Christmas tree 10/tubing hanger 31, respectively. The pressure of the supplied fluid is monitored and, after testing, a visual inspection is carried out to look for signs of any fluid leakage past the seals concerned.

Leakage of fluid around the wet-mate connector 26 could cause the pressure in the further passage 22 to build up to a much higher level than can be contained by the electrical bulkhead connector 24. While this could result in the immediate and obvious failure of the electrical bulkhead connector 24, it also may not. As described above, the electrical bulkhead connector 24 could hold the pressure for some time during which operators start to examine the Christmas tree to determine the source of the leak, and the electrical bulkhead connector 24 fail catastrophically whilst the examination is taking place. This could, for example, result in the electrical bulkhead connector 24 being blown off into one of the operators conducting the examination, causing significant injury.

This can, however, be avoided if the sensor 30 in the further passage 22 is a pressure sensor, as this sensor 30 can be used to monitor the fluid pressure in the further passage 22 during the testing. If the operator determines that the fluid pressure in the further passage 22 is approaching the maximum pressure which can safely be contained by the electrical bulkhead connector 24, the test can be stopped by ceasing the pumping of test fluid, the fluid drained from the Christmas tree 10, and steps taken to address the inability of the wet-mate connector 26 to provide an effective seal, before the Christmas tree 10 is pressure tested again.

The sensor 30 can also be used to monitor the conditions in the further passage 22 after the Christmas tree 10 has been commissioned and is in use controlling the flow of production fluid from a wellbore.

The present invention is not limited to embodiments described herein; reference should be had to the appended claims.

LIST OF REFERENCE NUMERALS

10 Christmas tree
12 Wellhead
14 Main body
14*a* First end (of main body 14)
14*b* Second end (of main body 14)
14*c* Radially outwardly facing exterior surface (of main body 14)
14*d* Shoulder (of main body 14)
16 Main passage
16*a* First portion (of main passage 16)
16*b* Second portion (of main passage 16)
18 Main fluid flow passage
20 Production flowline connection
22 Further passage
22*a* First end (of further passage)
22*b* Second end (of further passage)
24 Electrical bulkhead connector
24*a* First electrical connection (of electrical bulkhead connector 24)
24*b* Second electrical connection (of electrical bulkhead connector 24)
24*c* Third electrical connection (of electrical bulkhead connector 24)
26 Wet-mate connector
26*a* First end (of wet-mate connector 26)
26*b* Second end (of wet-mate connector 26)
28 Cable
30 Sensor
31 Tubing hanger
31*a* Central passage (of tubing hanger 31)
32 Production casing
32*a* Central passage (of production casing 32)
34 Tube
34*a* Seal
34*b* Seal
34*c* Seal
36 Offset passage
38 Tubing hanger wet-mate connector
40 Further electrical cable
A Longitudinal axis

What is claimed is:

1. A Christmas tree comprising:

a main body comprising, a first main body end which is configured to be secured to a wellhead, a second main body end which is configured to be connected to a production flowline, wherein, the main body is configured to enclose a main passage as a first fluid flow path which extends from the first main body end to the second main body end so that a fluid in the wellhead can pass along the main passage to the production flowline, and a further passage comprising a first further passage end at an exterior of the main body and a second further passage end at the main passage, the further passage being configured to extend from the first further passage end to the second further passage end so as to provide a second fluid flow path from the main passage to the exterior of the main body;

an electrical bulkhead connector which is secured to the exterior of the main body so as to close the first further passage end, the electrical bulkhead connector comprising a first electrical connection and a second electrical connection;

a wet-mate connector which is mounted in the second further passage end so as to close the second further passage end;

a cable which is configured to transmit an electrical signal and to electrically connect the first electrical connection of the electrical bulkhead connector to the wet-mate connector; and a sensor arranged in the further passage, the sensor being electrically connected to the second electrical connection of the electrical bulkhead connector.

2. The Christmas tree as recited in claim 1, wherein the sensor is a pressure sensor, a temperature sensor, a vibration sensor, or an acoustic sensor.

3. The Christmas tree as recited in claim 1, wherein the electrical bulkhead connector further comprises a third electrical connection which is configured to be earthed.

4. The Christmas tree as recited in claim 1, wherein the wet-mate connector comprises a first wet-mate end which is arranged in the second further passage end, and a second wet-mate end which extends into the main passage and which is configured to engage with and form an electrical connection with a further corresponding electrical connector.

5. The Christmas tree as recited in claim 1, wherein the electrical bulkhead connector further comprises a multi-pin electrical bulkhead.

6. The Christmas tree as recited in claim 1, wherein, the main passage comprises a first main passage portion with a longitudinal axis which, when the Christmas tree is mounted on the wellhead, extends generally parallel to a main fluid flow passage through the wellhead, and the main body further comprises a radially outwardly facing exterior surface which is generally parallel to the longitudinal axis of the first main passage portion.

7. The Christmas tree as recited in claim 6, wherein the first further passage end forms a port in the radially outwardly facing exterior surface of the main body.

8. The Christmas tree as recited in claim 6, wherein the main body further comprises a production flowline connector which is configured to be connected to the production flowline so that the fluid can flow from the main passage into the production flowline.

9. The Christmas tree as recited in claim 8, wherein, the main passage further comprises a second main passage portion which extends generally perpendicular to the first main passage portion through the production flowline connector, and the production flowline connector is arranged on the radially outwardly facing exterior surface of the main body.

10. The Christmas tree as recited in claim 6, wherein the second further passage end extends into the first main passage portion.

11. The Christmas tree as recited in claim 6, wherein the further passage further comprises a first further passage portion which extends into the main body from the radially outwardly facing exterior surface of the main body, and a second further passage portion which extends into the main body to the first further passage portion from the first main passage portion.

12. The Christmas tree as recited in claim 11, wherein, the first main passage portion has a larger diameter portion at the first main body end and a smaller diameter portion which extends from the larger diameter portion to the second main passage portion, and the main body further comprises a shoulder between the larger diameter portion and the smaller diameter portion of the main passage, the shoulder extending generally perpendicular to the longitudinal axis of the first main passage portion.

13. The Christmas tree as recited in claim 12, wherein the second further passage end extends to and forms a port in the shoulder.

14. The Christmas tree as recited in claim 11, wherein the second further passage portion extends generally parallel to the longitudinal axis of the first main passage portion.

15. A well completion assembly comprising:

a wellhead comprising the Christmas tree as recited in claim 1; and a tubing hanger mounted in the wellhead.

16. The well completion assembly as recited in claim 15, wherein, the tubing hanger comprises a corresponding wet-mate connector, and the wet-mate connector of the Christmas tree is connected to the corresponding wet-mate connector provided in the tubing hanger.

17. A method of pressure testing the Christmas tree as recited in claim 1, wherein the sensor comprises a pressure sensor, the method comprising:

pumping a pressurized fluid into the main passage; and using the pressure sensor to monitor a pressure in the further passage.

* * * * *